US005905227A

United States Patent [19]

Eichert et al.

[11] Patent Number: 5,905,227

[45] Date of Patent: May 18, 1999

[54] METHOD AND SYSTEM FOR WEAKENING A DETONATION IN A CONTAINER OR PIPING SYSTEM

[75] Inventors: Helmut Eichert, Neukirchen; Frank Heinrich, Braunschweig; Thomas Kratzel, Waiblingen; Eberhard Pantow, Stuttgart, all of Germany

[73] Assignees: Leinemann GmbH & Co., Braunschweig; DLR Deutsche Forschungsanstalt fur Luft- und Raumfahrt e.V., Koln, both of Germany

[21] Appl. No.: 08/807,673

[22] Filed: Sep. 26, 1996

[30] Foreign Application Priority Data

Sep. 29, 1995 [DE] Germany ..... 195 36 292

[51] Int. Cl.[6] ..... F42B 3/00

[52] U.S. Cl. ..... 102/316; 102/530; 588/202

[58] Field of Search ..... 102/303, 316, 102/530, 531; 588/202, 203

[56] References Cited

U.S. PATENT DOCUMENTS

| | | | |
|---|---|---|---|
| 1,504,824 | 8/1924 | Kruskopf | 102/316 |
| 3,814,016 | 6/1974 | Leach et al. | 102/22 |
| 4,537,133 | 8/1985 | Mainiero | 102/316 |
| 5,364,127 | 11/1994 | Cuevas | 280/741 |
| 5,386,779 | 2/1995 | Baker | 102/303 |

FOREIGN PATENT DOCUMENTS 1 192 980 6/1971 Germany .

OTHER PUBLICATIONS

Ullmann's Encyclopedia of Industrial Chemistry; Fifth Edition; vol. B8: Environmental Protection and Industrial Safety II; pp. 145–146 and 341–342.

J. Lee; Dynamic Parameters of Gaseous Detonations; Ann. Ref. Fluid Mech., 1984;, vol. 16, pp. 311–336.

*Primary Examiner*—Peter A. Nelson
*Attorney, Agent, or Firm*—Whitham, Curtis & Whitham

[57] ABSTRACT

A method for weakening a detonation in a container or piping system by dividing up the starting detonation front and bringing it together in an expansion space. The detonation front is divided into a main front and a secondary front and the main front is routed into the expansion space with a longer propagation time, in such a way that when the main front enters into the expansion space, the space contains combustion gases of the secondary front.

33 Claims, 4 Drawing Sheets

METHOD AND SYSTEM FOR WEAKENING A DETONATION IN A CONTAINER OR PIPING SYSTEM

DESCRIPTION

Background of the Invention

1. Field of the Invention

The present invention generally relates to a method for weakening a detonation in a container or piping system, in which a starting detonation front is divided up and brought back together in an expansion space.

The invention further relates to a system for weakening a detonation in a container or piping system having a wall arrangement, situated in the path of propagation of the detonation front, to divide up and reroute the detonation front and having an expansion space in which the divided detonation front is brought back together.

2. Description of the Related Art

The spreading out of an explosion of an ignitable gas mixture in a container or piping system can take place as detonation or as deflagration. In the case of detonation, the flame front and the shock front formed by the pressure wave of the explosion are superimposed over each other, while in the case of deflagration, the shock waves rush ahead of the flame front. The flame propagation speed of deflagrations is several hundred m/sec. and the combustion pressures in the shock direction are up to 10 bar (with a 1 bar initial pressure of the mixtures), while in the case of detonations, flame propagation speeds of several thousand m/sec. and pressures in the shock direction of up to 100 bar can occur.

It is known to avoid the destructive action of detonations by weakening or ending the detonation and in so doing, to preferably extinguish the flames of the flame front of the detonation. Often, so-called "detonation brakes" or "detonation shock-absorbers" are therefore combined with a flame trap that has a number of narrow, long gaps in which the flame is cooled off so much that it is extinguished.

A detonation safety cut-out consisting of a detonation brake and a flame trap is known through DE-PS 1 192 980. In this system, the detonation front being propagated through a conduit is divided up by the convex outside of a cylindrically designed wall and makes its way into an expansion space with an enlarged volume in relation to the conduit. Only after several reroutings can the divided detonation front run against the flame trap which is attached in an output connecting piece that is at a 90° angle in relation to the conduit in which the detonation originally spreads out. The several reroutings become necessary because a second semi-cylindrical wall with a smaller diameter is provided, whereby the fine wall fragments pointing toward each other are arranged overlapping each other and thereby form a kind of labyrinth. In these conventional systems, the partial detonation fronts running toward each other can trigger a subsequent detonation, in particular if unfavorable mixture conditions are present. It is therefore necessary to dimension the flame trap in such a way that it has a secure flame-extinguishing action in this case as well. The flame-extinguishing gaps of the flame trap must be dimensioned sufficiently long and sufficiently narrow, whereby, however, for normal operation during throughflow of the operating medium, a relatively high pressure loss must be accepted. Furthermore, an increased maintenance expense is caused by narrow, long passage gaps.

SUMMARY OF THE INVENTION

It is therefore an object of the present invention to provide a structure and method for improving the weakening of the detonation in a container or piping system.

The above-described technical problem associated with conventional systems is solved according to the invention with a method of where the detonation front is divided up into at least one main front and a secondary front. The main front is routed into an expansion space through a longer route than the secondary front, in such a way that when the main front enters into the expansion space, the expansion space contains post-combustion gases of the secondary front which decompose the combustible gases of the main front.

While the operation of the conventional systems for detonation weakening are based on the detonation front being rerouted to reduce the propagation speed and consume energy, the solution according to the invention is based on a preferably smaller portion of the detonation front being rerouted as a secondary front into the expansion space before the main front and burning off in the expansion space, preferably in the form of a deflagration, in such a way that when entering the expansion space the main front finds essentially post-combustion gases, whereby the propagation of the detonation is prevented in such a way that the main front decomposes (i.e., by deflagration). The propagation time of the main front is dimensioned relative to the secondary front in such a way that the secondary front will have already decomposed in the expansion space by the time the main front enters the expansion space.

The method according to the invention can be used in all containers or piping systems to prevent or at least weaken detonations. For points of junction into other systems or to the outside, a flame trap is useful. The improved action of the detonation weakening according to the invention results in the flame trap being able to have wider and shorter flame-extinguishing gaps, whereby the pressure loss caused by the flame trap is reduced.

The method according to the invention is particularly effective when the secondary front is routed to a side exit of the expansion space (i.e., directly to the flame trap). The opposite movement and burning off of the secondary front before the main front enters the expansion chamber leads to an improved, more secure weakening of the detonation.

A system of the invention comprises a wall arrangement that forms a first route for the main front and a second route for the secondary front of the detonation front, whereby the routes are dimensioned in such a way that the main front enters the expansion space delayed in relation to the secondary front. In this regard, the total cross-section of the first route is considerably greater, preferably at least four times greater, than the total cross-section of the second route.

To ensure that when entering the expansion chamber, the detonation of the secondary front has switched over to a deflagration, in a preferred form of the invention, the second route is formed from at least one opening or at least one section of conduit, the diameter of each of which is below a critical diameter. The term "critical diameter" is based on the knowledge that below a certain diameter of a section of conduit, the shock front and the flame front can no longer progress together and are therefore separated.

For the above-mentioned reasons, the expansion space can be closed off at the end, flow-wise in relation to the wall arrangement, by a flame trap with flame-extinguishing gaps.

For a compact system that avoids unnecessarily long delays of the main front, it is useful for the second route to allow the secondary front direct passage into the expansion space, essentially without rerouting. This is particularly useful when the separation of the flame front and the shock front is already ensured by having a diameter below the critical diameter, in such a way that energy-consuming reroutings for the secondary front are no longer necessary. Since the secondary front proceeds essentially without delay, the delay required for the main front is minimized.

In a simple form of the invention, the second route can be formed by at least one opening, situated in propagation direction of the detonation front, in the wall arrangement. Alternatively, the second route is formed by at least one section of conduit situated in the propagation direction of the detonation front. The section of conduit can end shortly before the flame trap, to ensure the opposite movement of the burning down of the flame of the secondary front and the main front's entry into the expansion space. In the case of a flame trap arranged in a perpendicular piece of pipe, the section of conduit could be bent accordingly.

The wall arrangement of the system according to the invention can have a cylindrical wall section that divides and reroutes the detonation front into two main fronts and that has at least one opening or a section of conduit for the secondary front to pass through.

Alternatively, the wall arrangement has, for enclosing the starting detonation front, a cup-shaped wall in the bottom of which there is at least one opening or one section of conduit as second route for the secondary front to pass through. This allows the first route to run along the outside of the cylindrical sections of the cup-shaped wall.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
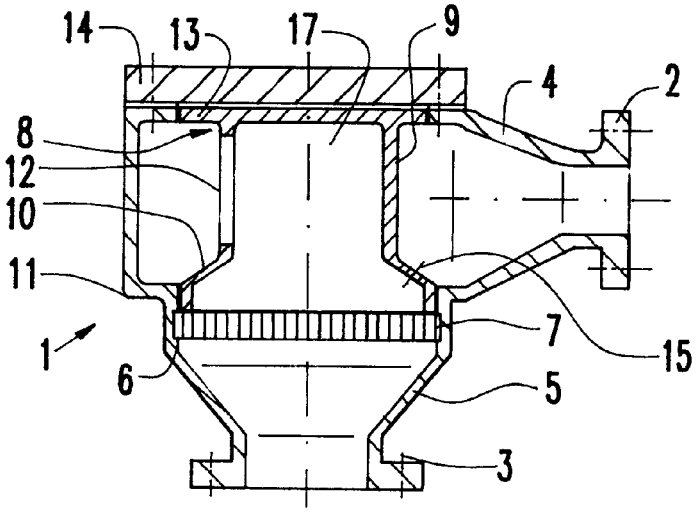
FIG. 1 is a vertical sectional view of a first embodiment of the invention designed with a bend.
Figure 2:
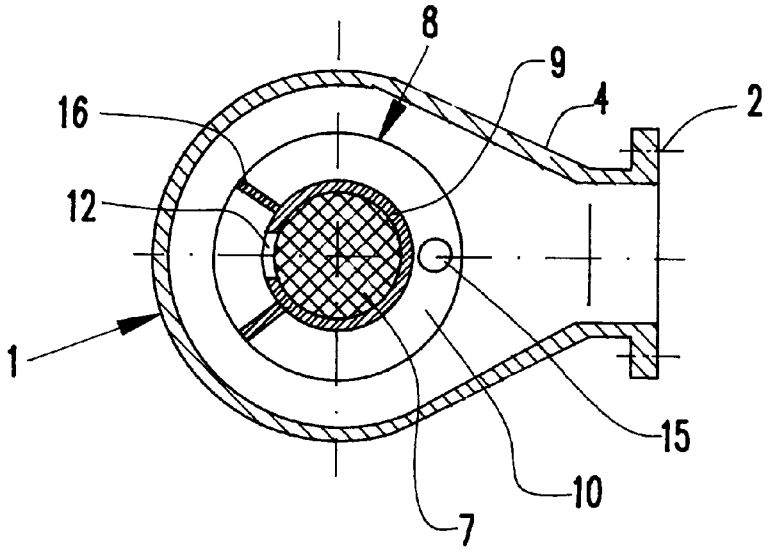
FIG. 2 is a horizontal sectional view of the first embodiment of shown in FIG. 1.

Referring now to the drawings, and more particularly to FIGS. 1 and 2, shown is a housing 1, designed with a bend, with a connecting flange 2 at the entry side with respect to the possible detonation and, at the exit side, a connecting flange 3 at a 90° angle to the entry side. Both connecting flanges 2,3 have walls 4,5 that conically widen toward the inside of the housing 1.

In the widened part of the wall 5 of the connecting flange 3, there is a step 6 onto which a flame trap 7 is positioned. The flame trap 7 is held in place by an insert 8 of the housing 1. The insert 8 has an essentially cylindrical wall 9 that is extended by a transition piece 10 into a lower, free edge 11 adjacent to the flame trap 7.

On the side opposite the entry-side flange 2, the cylindrical wall 9 has a slit-shaped opening 12. The insert 8 is closed off on the side opposite the exit-side connecting flange 3 by a flat plate 13. In the aggregate, the insert 8 is held and sealed in place by a lid 14 screwed onto the housing 1.

In the transition piece 10, there is an opening 15 with a diameter that is less than ¼ of the largest diameter of the connecting flange 2. The opening 15 is positioned closer to the flame trap 7 than to the flat plate 13.

As illustrated in FIG. 2, the cylindrical wall 9 also has, in the area opposite the entry flange 2 and toward the side of the opening 12, radial reinforcing ribs 16 that extend radially up to the height of the free edge 11.

A detonation front entering through the entry-side connecting flange 2 of the housing 1 makes its way onto the cylindrical wall 9 and is divided up. Because of the symmetry of the arrangement, two main fronts are formed that run around the cylindrical wall 9 and the reinforcing ribs 16 and enter through the opening 12 into an expansion space 17 within the interior of the cylindrical wall 9. The main fronts thus make their way via the described first route into the expansion space 17 and to the flame trap 7.

A small portion of the detonation front passes through the opening 15 as secondary front and makes its way directly into the expansion space 17 and to the front of the flame trap 7. The opening 15 thus forms a second route on which a secondary front of the detonation front makes its way into the expansion space 17.

Since the main fronts must travel a longer distance into the expansion space 17 than the secondary front, the secondary front makes its way into the expansion space 17 before the main fronts. The secondary front decomposes in the expansion space 17 and burns down as deflagration before the main fronts enter the expansion space. When the main fronts enter into the expansion space, the secondary front is thus at least partially (preferably completely) filled with "post-combustion" (i.e., previously combusted) gases, in such a way that the main fronts no longer find any combustible gases (or only small quantities of combustible gases) in the expansion space 17. The post-combustion gases cannot absorb enough energy for flame propagation. The main fronts therefore also decompose in the expansion space 17 before they reach the flame trap 7.

The flame trap 7 thus only needs to be designed for the considerably less dangerous deflagrations, i.e., it can have considerably broader and shorter gaps than conventional flame traps. In this way, a lesser flow resistance is formed and the maintenance of the flame trap 7 is reduced.

Figure 3:
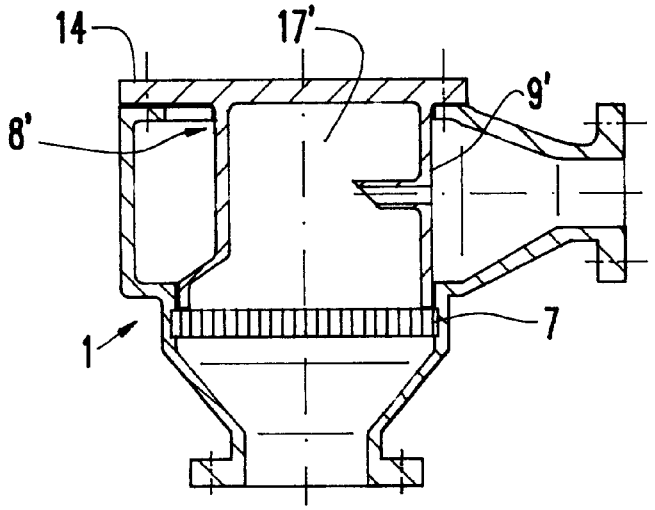
FIG. 3 is a vertical sectional view of a second embodiment of the invention designed with a bend.
Figure 4:
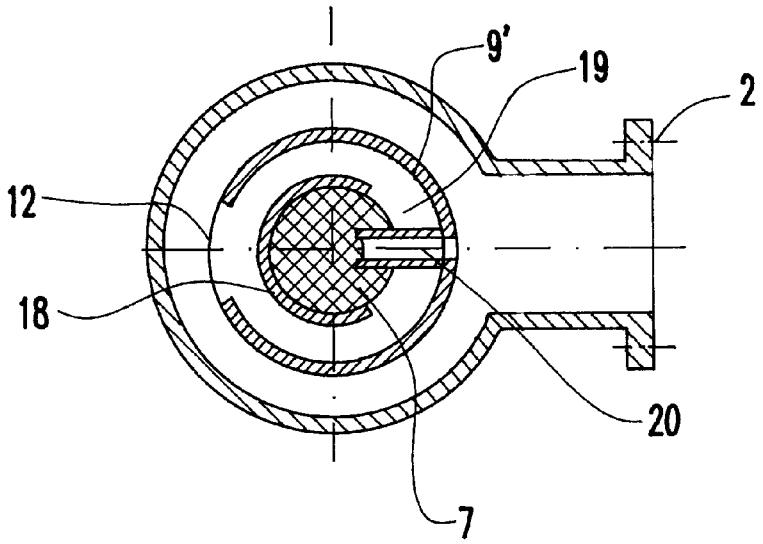
FIG. 4 is a horizontal sectional view of the embodiment shown in FIG. 3.

In the embodiment of the invention shown in FIGS. 3 and 4, the insert 8' also forms the lid 14 of the longitudinal housing 1. The cylindrical wall 9' has a diameter corresponding to the outer diameter of the flame trap 7. Flush with the opening 12 on the side opposite the entry-side connecting flange is a second cylindrical wall section 18, which is arranged concentrically with the cylindrical wall 9', but with smaller diameter. An opening 19 of the cylindrical wall section 18 points toward the connecting flange 2 on the entry side, in such a way that the partial main fronts formed by the cylindrical wall 9' make their way through a labyrinth formed by the openings 12,19 into the expansion space 17' above the flame trap 7.

Along the axis of the connecting flange 2, in the cylindrical wall 9' there is a section of conduit 20 protruding into the expansion space 17'.

As discussed above, below a "critical diameter" of a section of conduit, the shock front and the flame front can no longer progress together and are therefore separated. Explanations of the term "critical diameter" are found in an article by J. H. S. Lee *Dynamic Parameters of Gaseous Detonations*, Ann.Rev.Fluid.Mech 16 (1984), pp. 311 through 336.

The conduit 20 has a diameter below the "critical diameter" and directly routes the secondary front into the expansion space 17' (without rerouting). To the contrary, the main front makes its way into the expansion space 17' after being rerouted and delayed several times. This additional delay increases the above-described advantages of the invention.

Figure 5:
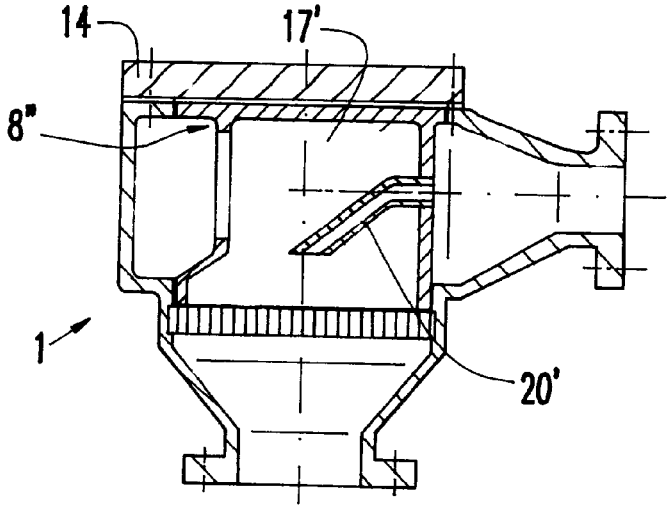
FIG. 5 is a vertical sectional view of a third embodiment of the invention designed with a bend.
Figure 6:
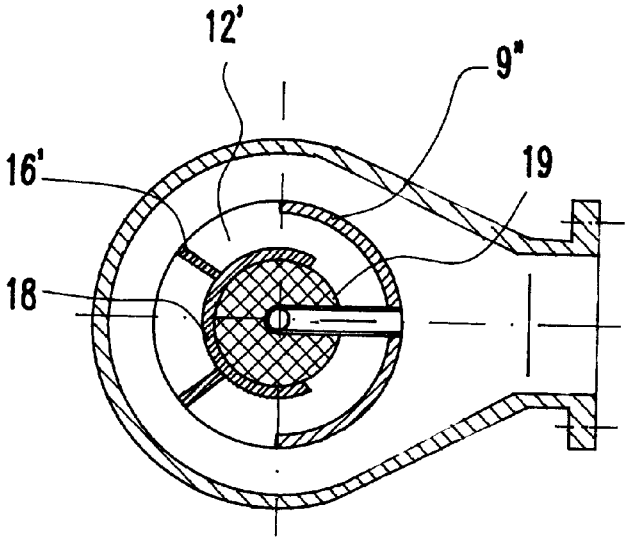
FIG. 6 is a horizontal section of the embodiment shown in FIG. 5.

In the third embodiment of the invention shown in FIGS. 5 and 6, compared with the second embodiment of the invention shown in FIGS. 3 and 4, the section of conduit 20' is bent downward, to more directly route the secondary front into the expansion space 17' and closer to the flame trap 7. Furthermore, the cylindrical wall 9" is designed as semicircular section. The second cylindrical wall section 18 is provided with radial ribs 16' which, together with the ends of the circular wall section 9", form entry openings 12' that are situated at the side of the wall arrangement and, together with the opening 19, bring about the several reroutings of the main fronts. In this embodiment of the invention, the insert 8"—as in the first embodiment of the invention—is held in place with a separate lid 14. The third embodiment provides even more delay between the main and secondary fronts to thereby more completely achieve the above-described benefits of the invention.

Figure 7:
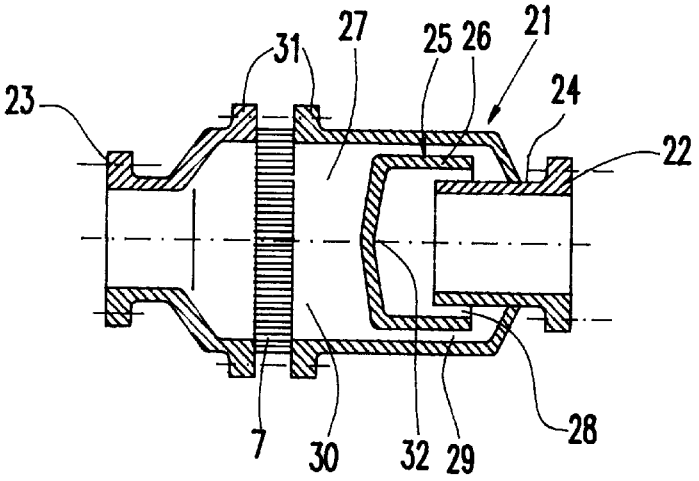
FIG. 7 is a vertical sectional view of a linearly designed fourth embodiment of the invention.

In a fourth embodiment of the invention, that is shown in FIG. 7, a housing 21 has, along a common axis, a connecting flange 22 at the entry side and a connecting flange 23 at the exit side. The connecting flange 22 at the entry side ends with a cylindrical section of conduit 24 in the interior of the housing 21 and is overlapped by a cup-shaped wall 25.

The cup-shaped wall 25 comprises a cylindrical covering wall 26 and a cylindrical bottom 27 curved away from the connecting flange 22 at the entry side. Annular gaps 28,29 that form a labyrinth are formed between the tubular section of conduit 24 and the cylindrical wall 26 on the one hand and between the cylindrical wall 26 and the housing 21 on the other hand.

The annular gaps 28,29 form a labyrinth for detonation. The main front enters into the cup-shaped wall 25, exits in reflected manner from the cup-shaped wall 25 via the inner annular gap 28, and after being rerouting by 180°, enters through the outer annular gap 29 into an expansion chamber 30 that is closed by a flame trap 7. The flame trap 7 is inserted between two parts of the housing 21 and is closed off with attachments flanges 31, that are connected together, for example, by screws. That part of the housing 21 not containing the expansion space 30 contains a taper to the connecting flange 23 at the exit side.

In this fourth embodiment of the invention, the secondary front is routed, through an opening 32 in the cylindrical wall 26 that is situated along the axis of the connecting flange 22. The opening 32 allows the secondary front to pass into the expansion space 30 without rerouting.

Figure 8:
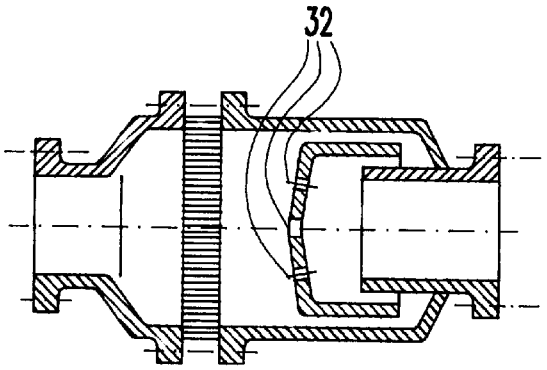
FIG. 8 is a vertical sectional view of a linearly designed fifth embodiment of the invention.

In the fifth embodiment of the invention shown in FIG. 8, which essentially similar to fourth embodiment shown in FIG. 7 (and the similar identification numbers thereof are omitted for clarity), arranged in the bottom 27 of the cup-shaped wall 25 symmetrically in relation to the axis of the connecting flange 22 at the entry side are several openings 32.

Figure 9:
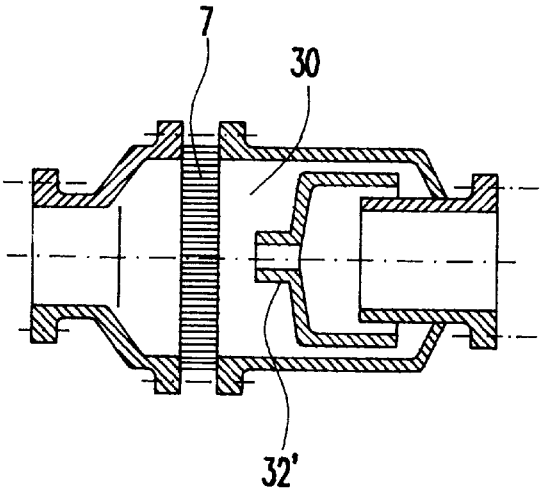
FIG. 9 is a vertical sectional view of a linearly designed sixth embodiment of the invention.

The embodiment of the invention shown in FIG. 9 also corresponds to the embodiment of the invention shown in FIG. 7 (again, for clarity, duplicate identification numbers are omitted) with the difference being that instead of the multiple openings 32, a section of conduit 32' is provided. The secondary front is routed through the conduit 32' into the expansion space 30 close to the flame trap 7.

All embodiments of the invention shown allow an effective weakening or ending of the detonation and thus only a slight burdening of the flame traps 7 occurs.

Having thus described our invention, what we claim as new and desire to secure by Letters Patent is as follows:

1. A system for weakening a detonation comprising:

a container having walls for dividing and rerouting a detonation front into a main front and a secondary front and having an expansion space in which said main front and said secondary front are brought back together, wherein said walls comprise a first route for said main front and a second route for said secondary front, whereby the routes are dimensioned in such a way that said main front enters into said expansion space delayed in relation to said secondary front.

2. A system according to claim 1, wherein a total cross-section of said first route is greater than a total cross-section of said second route.

3. A system according to claim 2, wherein said total cross-section of said second route is less than ¼ of said total cross-section of said first route.

4. A system according to claim 1, wherein said second route comprises at least one opening or at least one section of conduit, wherein a diameter of said opening and a diameter of said conduit is less than a critical diameter.

5. A system for weakening a detonation, comprising:

a container having walls for dividing and rerouting a detonation front into a main front and a secondary front and having an expansion space in which said main front and said secondary front are brought back together, at least one wall of said expansion space being formed by a flame trap having flame-extinguishing gaps, wherein said walls comprise a first route for said main front and a second route for said secondary front, whereby the routes are dimensioned in such a way that said main front enters into said expansion space delayed in relation to said secondary front.

6. A system according to claim 1, wherein said second route allows said secondary front direct passage into said expansion space without rerouting.

7. A system according to claim 1, wherein said second route comprises at least one opening situated in a direction of propagation of said detonation front.

8. A system according to claim 1, wherein said second route comprises at least one section of conduit positioned in a direction of propagation of said detonation front.

9. A system according to claim 8, wherein said section of conduit has an end adjacent a flame trap.

10. A system according to claim 8, wherein a section of conduit has a bend toward said flame trap.

11. A system according to claim 1, wherein said walls comprise a cylindrical wall for dividing and rerouting said detonation front into two main fronts and said walls have at least one opening or one section of conduit for allowing said secondary front to pass.

12. A system according to claim 1, wherein said walls comprise a cup-shaped wall in a bottom having at least one opening or one section of conduit as said second route for said secondary front to pass through, wherein said first route runs along an outside of cylindrical sections of said cup-shaped wall. space.

13. A system according to claim 1, wherein said walls include a first wall and a second wall within said first wall, said expansion space being located within said second wall, and wherein said second wall includes a first opening through which said main front passes for entering into said expansion space and a second opening through which said secondary front passes for entering into said expansion space, said first opening being disposed along said first route and said second opening being disposed along said second route.

14. A system according to claim 13, wherein the second route is shorter than the first route by an amount which allows said secondary front to burn at least a portion of combustible gas in said expansion space before said main front enters into said expansion space, so that when said main front enters said expansion space said expansion space is at least partially filled with non-combustible gas, thereby causing said main front to decompose.

15. A system according to claim 13, wherein the second route is shorter than the first route by an amount which allows said secondary front to burn substantially all of combustible gas in said expansion space before said main front enters into said expansion space, so that when said main front enters said expansion space said expansion space is substantially empty of combustible gas, thereby causing said main front to decompose.

16. A system according to claim 13, wherein said container further includes an inlet for said detonation front, said second opening being located nearer to said inlet that said first opening.

17. A system according to claim 16, wherein, when said detonation front enters said inlet, a front portion of said second wall divides said detonation front into said main front and said secondary front and then diverts said main front along said first route and diverts said secondary front along said second route, and wherein said first route is located between a first outer surface of said second wall and an interior surface of said first wall.

18. A system according to claim 17, wherein a first portion of said main front passes through said first route and a second portion of said main front passes along a third route, said third route being located between a second outer surface of said second wall and the interior surface of said first wall, said first route and said third route guiding, respectively, the first portion and the second portion of said main front into said expansion space through said first opening.

19. A system according to claim 18, wherein the first outer surface and the second outer surface of said second wall are disposed in opposing relation, so that said first route and said third route pass along opposite sides of said second wall.

20. A system according to claim 18, wherein said first route and said third route are substantially equal in length, so that the first and second portions of said main front enter into said expansion space substantially simultaneously.

21. A system according to claim 16, wherein said second opening in said second wall is disposed in opposing relation to said first opening.

22. A system according to claim 13, wherein said first wall and said second wall are at least partially cylindrical in shape, and wherein said second wall is concentrically disposed relative to said first wall.

23. A system according to claim 1, further comprising:

a flame trap disposed along a bottom portion of said container, said flame trap being a type for extinguishing a deflagration.

24. A system according to claim 1, wherein the secondary front burns down as deflagration before the main front enters said expansion space.

25. A system according to claim 13, wherein said container further includes a conduit extending from said second opening for leading said secondary front into said expansion space.

26. A system according to claim 13, wherein said container includes a third wall within said second wall, said third wall having a third opening leading into said expansion space, and wherein an outer surface of said third wall and an interior surface of said second wall form an extension of said first route to delay entry of said main front into said expansion space by an additional amount, said main front passing into said expansion space through said third opening.

27. A system according to claim 26, wherein said second wall further includes a conduit extending from said second opening for leading said secondary front into said expansion space through said third opening.

28. A system according to claim 27, wherein said conduit is bent downwardly towards a flame trap disposed at a bottom of said container.

29. A system according to claim 27, wherein said first, second, and third walls are at least partially cylindrical in shape and concentrically disposed relative to one another.

30. A system according to claim 29, wherein said second and third walls are substantially semicircular in section and concentrically disposed so that the third opening is facing said first opening.

31. A system according to claim 30, wherein said third wall includes at least one rib which, together with a leading edge of the second wall, forms said first opening.

32. A system according to claim 1, wherein said expansion space is located within said walls which divide and reroute the detonation front.

33. A system for weakening a detonation, comprising:

a container/piping system including a propagation way for a detonation front; and a wall arrangement forming the propagation way of said detonation front for dividing and rerouting said detonation front into a main front and a secondary front for forming an expansion space in which said main front and said secondary front are brought back together, wherein said wall arrangement comprises a first route for said main front and a second route for said secondary front, whereby the routes are dimensioned in such a way that said main front enters into said expansion space delayed in relation to said secondary front, and wherein a total cross-section of said first route is greater than a total cross-section of said secondary route.

* * * * *